US005111665A

United States Patent [19]

Ackermann

[11] Patent Number: 5,111,665

[45] Date of Patent: May 12, 1992

[54] REDUNDANT CRYOREFRIGERATOR SYSTEM FOR A REFRIGERATED SUPERCONDUCTIVE MAGNET

[75] Inventor: Robert A. Ackermann, Schenectady, N.Y.

[73] Assignee: General Electric Company, Schenectady, N.Y.

[21] Appl. No.: 656,920

[22] Filed: Feb. 19, 1991

[51] Int. Cl.[5] ..... F25B 9/00

[52] U.S. Cl. ..... 62/6; 62/51.1; 62/295; 62/297; 62/383; 505/894

[58] Field of Search ..... 62/51.1, 295, 297, 6, 62/383; 505/894

[56] References Cited

U.S. PATENT DOCUMENTS 4,852,367 8/1989 Dustmann ..... 62/51.1
4,873,843 10/1989 Volten ..... 62/51.1
5,010,737 4/1991 Okumura et al. ..... 62/6

*Primary Examiner*—Ronald C. Capossela
*Attorney, Agent, or Firm*—James R. McDaniel; James C. Davis, Jr.; Paul R. Webb, II

[57] ABSTRACT

A cryorefrigerator mount for a refrigerated superconductive magnet is disclosed. In particular, a cryorefrigerator system has two separate cryorefrigerators such that one of the cryorefrigertors contacts and cools the magnet while the other cryorefrigerator is held in a raised, standby position. If the first cryorefrigerator malfunctions and can no longer cool the magnet, the second cryorefrigerator is lowered to contact and cool the magnet. The first cryorefrigerator is then raised so it can be repaired, serviced or replaced.

15 Claims, 2 Drawing Sheets

REDUNDANT CRYOREFRIGERATOR SYSTEM FOR A REFRIGERATED SUPERCONDUCTIVE MAGNET

BACKGROUND OF THE INVENTION

This invention relates to cryorefrigerators for refrigerated superconductive magnets of the type that have redundant mount assemblies, in order to improve the reliability of the cryorefrigerator. Such structures of this type generally allow at least one cryorefrigerator of the two used in the system to cool the magnet while another redundant cryorefrigerator is held in standby so that in case the first cryorefrigerator malfunctions, the redundant cryorefrigerator can be actuated whereby the cooling of the magnet should be constantly maintained. In particular, a cryorefrigerator having a main cryorefrigerator and a redundant cryorefrigerator contacts the superconductive magnet to be cooled. The redundant cryorefrigerator does not contact the magnet and is held in a raised, standby position until the main cryorefrigerator malfunctions. At that time, the redundant cryorefrigerator is activated so that it contacts the magnet and the main cryorefrigerator is raised so that it can be repaired, serviced or replaced. In this manner, the cooling of the magnet should be substantially continuous. The invention relates to certain unique cryorefrigerator assemblies and the mounting means in association therewith.

It is known, in prior cryorefrigerators to use a cryorefrigeration system which employs, typically, only one cryorefrigerator. In each of these cases, and of the major prohibitive factors to these systems was the fact that if the cryorefrigerator malfunctioned, the superconductive magnet, usually, could not be cooled, which,. in some cases, could adversely affect the magnet. In short, the system was, typically, only as reliable as the cryorefrigerator itself.

Consequently, a more advantageous system, then, would be presented if such amounts of unreliability were reduced or eliminated.

It is apparent from the above that there exists a need in the art for a cryorefrigerator which is reliable through simplicity of parts and uniqueness of structure, and which at least equals the cooling performance of known cryorefrigerators, but which at the same time substantially continuously cools the magnet. It is a purpose of this invention to fulfill this and other needs in the art in a manner more apparent to the skilled artisan once given the following disclosure.

SUMMARY OF THE INVENTION

Generally speaking, this invention fulfills these needs by providing a cryorefrigerator system for a refrigerated superconductive magnet, comprising a mounting means, at least two cryorefrigerator means mounted on said mounting means such that said cryorefrigerator means moves on said mounting means and at least one of said two cryorefrigerator means being substantially out of contact with said magnet, and an adjustment means for moving said at least one of said cryorefrigerator means.

In certain preferred embodiments, the mounting means is comprised of flexible thermal expansion joints and flexible thermal connections. Also, the adjusting means is comprised of jacking screws.

In another further preferred embodiment, the magnet is substantially continuously cooled by a redundant cryorefrigerator system having at least two cryorefrigerators in which one of the cryorefrigerators contacts and cools the magnet while the other cryorefrigerator is held in a stand-by position. If the first cryorefrigerator malfunctions, then, the second cryorefrigerator is substantially immediately activated to continue the cooling process and the first cryorefrigerator is placed in stand-by so it can be repaired, serviced or replaced.

In particularly preferred embodiments, the cryorefrigerator of this invention consists essentially of two cryorefrigerators contained within the cryorefrigerator system such that one of the cryorefrigerators contacts the superconductive magnet to be cooled and the other cryorefrigerator is held in a stand-by position. If the first cryorefrigerator malfunctions, the operator manipulates a set of jacking screws on the second cryorefrigerator so that the second cryorefrigerator is lowered and contacts the magnet and continues cooling the magnet. The operator, then, manipulates the jacking screws on the first cryorefrigerator which causes this cryorefrigerator to be placed in a raised, stand-by position so that it can be repaired, serviced or replaced.

The preferred cryorefrigerator system, according to this invention, offers the following advantages: ease of repair and replacement; good cooling characteristics; good stability; excellent reliability; excellent economy; and high strength for safety. In fact, in many of the preferred embodiments, these factors of reliability, economy, and ease of repair and replacement are optimized to an extent considerably higher than heretofore achieved in prior, known cryorefrigerator systems.

BRIEF DESCRIPTION OF THE DRAWINGS

This invention now will be described with respect to certain embodiments thereof as illustrated in the accompanying drawings, in which.

DETAILED DESCRIPTION OF THE INVENTION

Figure 1:
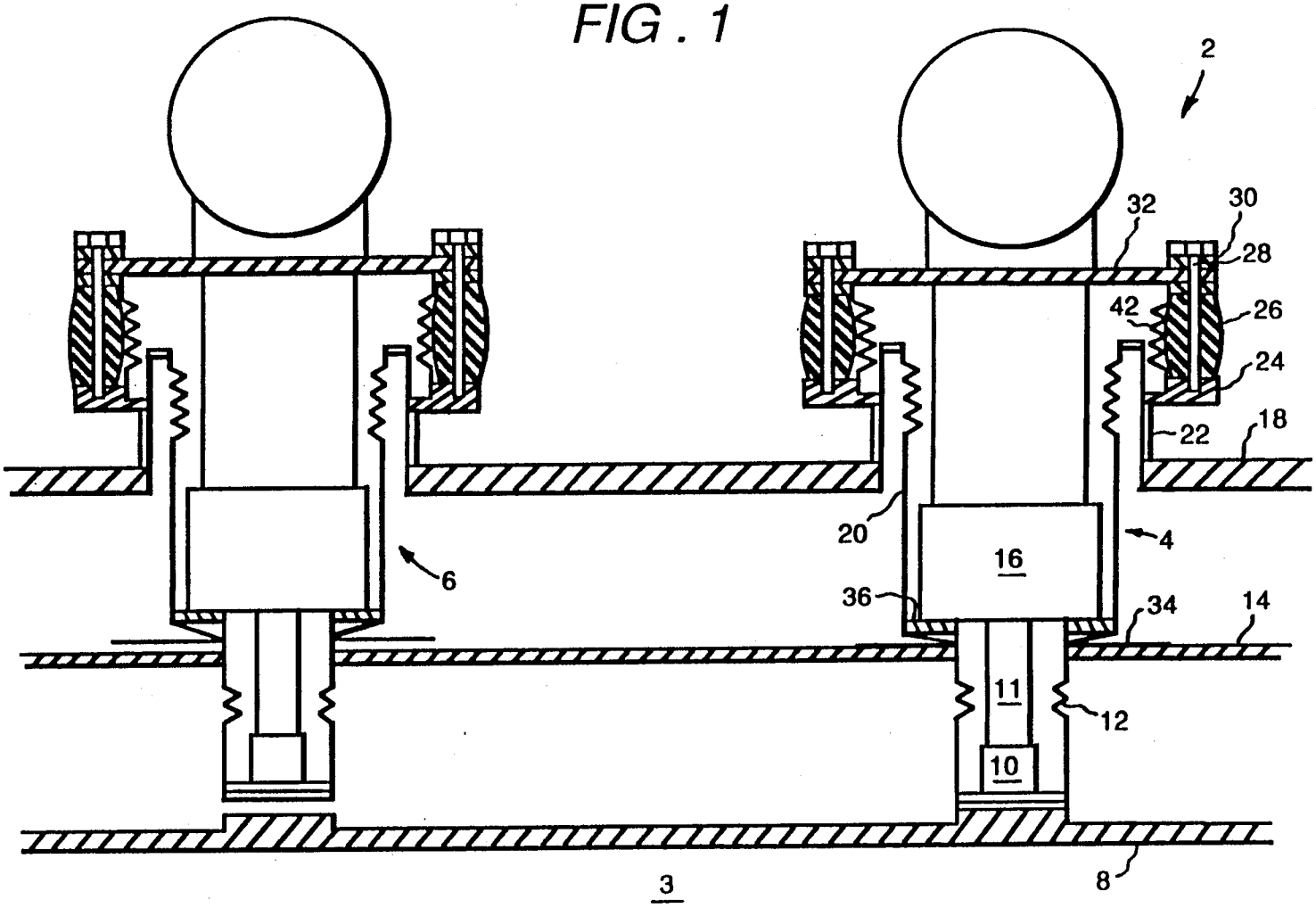
FIG. 1 is a schematic drawing of a redundant cryorefrigerator system, according to the invention.

With reference to FIG. 1, there is illustrated a redundant cryorefrigerator system 2. System 2 includes activated cryorefrigerator 4 and stand-by 6. Because the elements are the same between cryorefrigerators 4 and 6, only those elements in cryorefrigerator 4 will be and need be discussed with respect to FIG. 1.

Generally, cryorefrigerator 4 contains second stage hard connection 10, second stage cryorefrigerator 11, bellows 12, first stage cryorefrigerator 16, first stage thermal station 36, first stage flexible thermal connection 34, bellows 20, vacuum vessel 18, vacuum vessel support 22, thermal standoff 24, isopad 26, bellows 42, jacking screw 28, isopad 30 and cryorefrigerator mounting plate 32.

Second stage hard connection 10, preferably, constructed of copper, contacts magnet cartridge 8 of superconductive magnet 3, to substantially maintain cartridge 8 at approximately a temperature of 10 K.

First stage thermal station 36, preferably, constructed of copper, contacts thermal shield 14 of magnet 3, to substantially maintain shield 14 at approximately a temperature of 40 K. The use of hard connection 10 and thermal station 36 to maintain temperatures of 10 K. and 40 K., respectively, is conventional.

Figure 2:
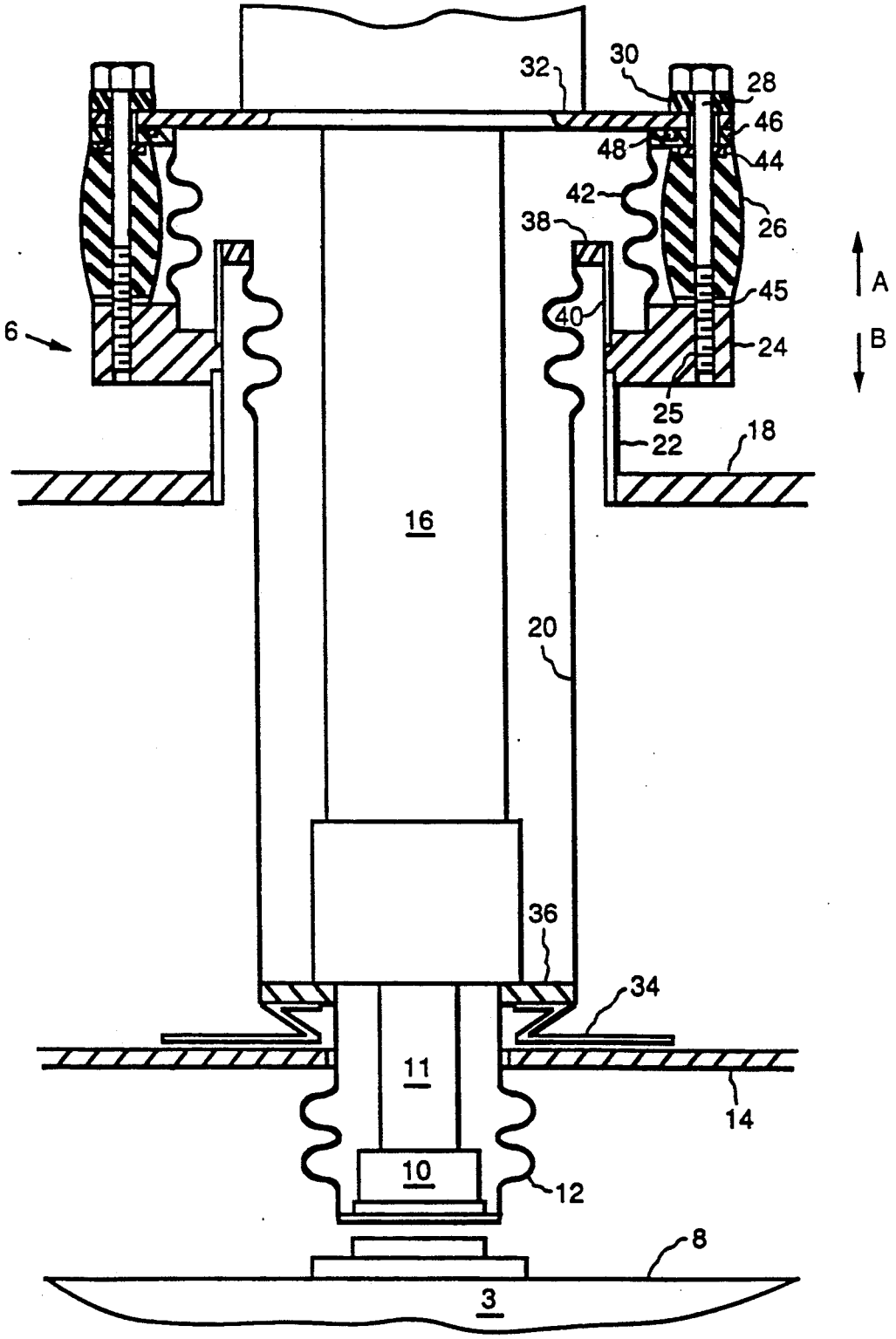
FIG. 2 is a detailed drawing of a cyrorefrigerator and its mount, according to the present invention.

With respect to FIG. 2, cryorefrigerator 6 is illustrated in its stand-by position. Again, the elements in cryorefrigerator 6 that are the same as those in cryorefrigerator 4 are given the same numerals.

In particular, second stage hard connection 10 is raised above cartridge 8 and first stage thermal station 36 is raised above thermal shield 14. In these stand-by positions, connection 10 should not cool cartridge 8 and thermal station 36 should not cool shield 14.

Bellows 12, preferably, constructed of non-magnetic stainless steel and formed by conventional bending techniques, are rigidly attached at one end to hard connection 10, preferably by brazing. The other end of bellows 12 are rigidly attached to thermal station 36, preferably, by brazing. Bellows 12 provide insulation for hard connection 10.

First stage cryorefrigerator 16 is rigidly attached, preferably, by brazing to thermal station 36. Thermal station 36, preferably, is constructed of copper.

First stage flexible thermal connection 34, is rigidly attached, preferably, by brazing to thermal station 36. Thermal connection 34, preferably, is constructed of any suitable high thermal conductivity material and is formed by bending.

Thermal station 36 and thermal connection 34 should act as heat conductors which conduct heat away from shield 14 and transfer the heat to first stage cryorefrigerator 16.

Bellows 20, preferably, is constructed of non-magnetic stainless steel and one end of bellows 20 is rigidly attached to thermal station 36, preferably, by brazing. The other end of bellows 20 is rigidly attached to one side of block 38, preferably, by brazing.

Block 38, preferably, is constructed of non-magnetic stainless steel and is rigidly attached, preferably, by brazing along its other side to one end of thermal standoff support 40. Standoff support 40, preferably, is constructed of non-magnetic, stainless steel. The other end of thermal standoff support 40 is rigidly attached, preferably, by brazing to one side thermal standoff 24. Thermal standoff 24, preferably, is constructed of non-magnetic, stainless steel.

Another side of thermal standoff 24 is rigidly attached, preferably, by brazing to one end of support 22. Support 22, preferably, is constructed of non-magnetic, stainless steel. The other end of support 22 is rigidly attached, preferably, by brazing to vacuum vessel 18.

Still another side of thermal standoff 24 is rigidly attached, preferably, by brazing to one end of bellows 42. Bellows 42, preferably is constructed of non-magnetic, stainless steel.

The other end of bellows 42 is rigidly attached, preferably, by brazing to penetration flange 46. Flange 46, preferably, is constructed of non-magnetic, stainless steel. Flange 46 also contacts one side of mounting plate 32.

Located within flange 46 is a conventional, elastomeric O-ring 48. O-ring 48 should act as a refrigeration seal for first stage cyrorefrigerator 16.

Located between flange 46 and thermal standoff 24 are isopad 26, adapter 44 and plate 45. Isopad 26, preferably, is constructed of any suitable conventional elastomeric material. Adapter 44 and plate 45, preferably, are constructed of non-magnetic stainless steel. Adapter 44 and plate 45 should protect isopad 26 from being adversely affected by flange 46 and thermal standoff 24, respectively, when jacking screw 28 is manipulated.

The other side of mounting plate 32 is contact by one side of isopad 30. Isopad 30, preferably, is constructed of any suitable elastomeric material. The other side of isopad 30 is contacted by jacking screw 30. Screw 30, preferably, is constructed of non-magnetic stainless steel. Screw 30 is threaded between isopad 28, mounting plate 32, flange 46, adapter 44, isopad 26, and plate 45 and engages in the threads 25 in thermal standoff 24.

It is to be understood that the area enclosed by mounting plate 32, bellows 42, thermal stand-off 24, O-ring 48, thermal stand-off support 40, block 38, bellows 20 and thermal station 36 is, preferably, evacuated by conventional evacuation techniques and should provide an insulating atmosphere for first stage cryorefrigerator 16. Also, bellows 12 and hard connection 10 should act substantially as a cryorefrigerator interface vessel which should provide an insulating atmosphere for second stage cryorefrigerator 11.

In operation, if it is desired to raise a cryorefrigerator, for example, to service, repair or replace the cryorefrigerator, the operator simply maneuvers, preferably, by turning jacking screws 28 to cause hard connection 10 and thermal station 36 to become disengaged from cartridge 8 and shield 14, respectively.

In particular, once jacking screws 28 are manuevered, to raise 6, thermal standoff 24, block 38, thermal station 36 and hard connection 10 move in the direction of arrow A. The movement of thermal standoff 24 should cause isopad 26 to become compressed and bellows 42 to flex. The movement of block 38, vessel 18, and thermal station 36 should cause bellows 20 to flex. The movement of thermal station 36, alone, should raise thermal connection 34 so that connection 34 should no longer be in contact with and, thus, cool shield 14. The movement of thermal station 36 and hard connection 10 should cause bellows 12 to flex so that hard connection 10 should no longer be in contact with and, thus, cool cartridge 8. Once the cryorefrigerator is in its raised, stand-by position (FIG. 2), it can be serviced, repaired or replaced.

After the cryorefrigerator has been repaired, serviced or replaced, the operator can either keep the cryorefrigerator in this stand-by position or, if the other cryorefrigerator has malfunctioned, the operator can manipulate, jacking screws 28 so that the cryorefrigerator contacts shield 14 and cartridge 8. If it is desired to place the cryrorefrigerator in contact with shield 14 and cartridge 8, the operator merely turns the jacking screws 28 and the cryorefrigerator should move in the direction of arrow B. It is to be understood that in the magnet contacting position, bellows 42, 20 and 12 are substantially unflexed and flexible thermal connection 34 is under compression and contacts shield 14.

Once given the above disclosure, many other features, modifications and improvements will become apparent to the skilled artisan. Such features, modifications and improvements are, therefore, considered to be a part of this invention, the scope of which is to be determined by the following claims.

What is claimed is:

1. A cryorefrigerator system for a refrigerated superconductive magnet which is comprised of:

a mounting means rigidly attached to said magnet;

at least two cryorefrigerator means mounted on said mounting means such that said cryorefrigerator means moves on said mounting means and at least one of said two cryorefrigerator means being substantially out of contact with said magnet; and an adjustment means rigidly attached to said cryorefrigerator means for moving said at least one of said cryorefrigerator means.

2. The cryorefrigerator system for a refrigerated superconductive magnet, according to claim 1, wherein said mounting means is further comprised of:

a mounting plate means;

a thermal stand-off means located adjacent said mounting plate means;

a first, second and third bellows means located adjacent said thermal stand-off means;

a block means located adjacent said thermal stand-off means;

a thermal station means located adjacent said block means; and a connection means.

3. The cryorefrigerator system for a refrigerated superconductive magnet, according to claim 2, wherein said first bellows means is located intermediate of and rigidly attached to said standoff means and said plate means.

4. The cryorefrigerator system for refrigerated superconductive magnet, according to claim 2, wherein said second bellows means is located intermediate of and rigidly attached to said block means and said thermal station means.

5. The cryorefrigerator system for refrigerated superconductive magnets, according to claim 2, wherein said third bellows means is located intermediate of and rigidly attached to said station means and said connection means.

6. The cryorefrigerator system for refrigerated superconductive magnets, according to claim 1, wherein said mounting plate, said first, second and third bellows means, and said stand-off means are constructed of nonmagnetic, stainless steel.

7. The cryorefrigerator system for refrigerated superconductive magnets, according to claim 1, wherein said thermal station means is constructed of copper.

8. The cryorefrigerator system for refrigerated superconductive magnets, according to claim 1, wherein said thermal station is further comprised of:

a thermal connection means.

9. The cryorefrigerator system for refrigerated superconductive magnets, according to claim 8, wherein said thermal connection means is flexible and is constructed of a high thermal conductivity material.

10. The cryorefrigerator system for refrigerated superconductive magnets, according to claim 1, wherein said adjustment means is further comprised of:

a mounting plate means;

a flange means located adjacent said mounting plate means;

an adapter means substantially contacting said flange means;

a first and second elastomeric means located adjacent said adapter means;

a protective plate means located adjacent said elastomeric means;

a thermal standoff means substantially contacting said protection plate means; and a fastener means substantially contacting said standoff means.

11. The cryorefrigerator system for refrigerated superconductive magnets, according to claim 10, wherein said first elastomeric means substantially contacts said mounting plate means.

12. The cryorefrigerator system for refrigerated superconductive magnets, according to claim 10, wherein said plate means substantially contacts said flange means.

13. The cryorefrigerator system for refrigerated superconductive magnets, according to claim 10, wherein said adapter means substantially contacts said second elastomeric means.

14. The cryorefrigerator system for refrigerated superconductive magnets, according to claim 10, wherein said second elastomeric means substantially contacts said protective plate means.

15. A cryorefrigeration method for refrigerating superconductive magnets having a mounting means, at least two cryorefrigerator means mounted on said mounting means such that at least one of said two cryorefrigerator means is substantially out of contact with said magnet and an adjustment means, comprising the steps of:

manipulating said adjustment means;

flexing said mounting means; and moving said at least one of said two cryorefrigerator means so that said at least one cyrorefrigerator means substantially contacts said magnet.

* * * * *